US007607856B2

(12) United States Patent
Patel

(10) Patent No.: US 7,607,856 B2
(45) Date of Patent: Oct. 27, 2009

(54) SHALLOW BOLLARD

(76) Inventor: Niraj Patel, 10421 Gary Rd., Rockville, MD (US) 20854

( * ) Notice: Subject to any disclaimer, the term of this patent is extended or adjusted under 35 U.S.C. 154(b) by 0 days.

(21) Appl. No.: 11/837,025

(22) Filed: Aug. 10, 2007

(65) Prior Publication Data

US 2008/0038056 A1 Feb. 14, 2008

Related U.S. Application Data

(60) Provisional application No. 60/822,240, filed on Aug. 13, 2006.

(51) Int. Cl.
*E01F 13/00* (2006.01)

(52) U.S. Cl. ..... 404/6

(58) Field of Classification Search ..... 40/606.01, 40/612; 404/6, 9, 10; 116/63 R, 63 P; 256/13.1
See application file for complete search history.

(56) References Cited

U.S. PATENT DOCUMENTS 3,693,940 A * 9/1972 Kendall et al. ..... 256/1
3,782,048 A * 1/1974 Corman ..... 52/733.2
3,863,900 A * 2/1975 Dagiel et al. ..... 256/59
3,967,906 A * 7/1976 Strizki ..... 403/2
4,543,905 A * 10/1985 McKenney ..... 116/63 P
5,542,203 A * 8/1996 Luoma et al. ..... 40/610
5,596,845 A * 1/1997 Strizki ..... 52/98
5,749,189 A * 5/1998 Oberg ..... 52/298
5,986,576 A * 11/1999 Armstrong ..... 340/908
7,325,999 B1 * 2/2008 Schindler et al. ..... 404/10
2006/0090408 A1 5/2006 Darcy
2007/0086858 A1 * 4/2007 Morgan et al. ..... 404/6

* cited by examiner

*Primary Examiner*—Gary S Hartmann
(74) *Attorney, Agent, or Firm*—Cermak Kenealy Vaidya & Nakajima LLP; Adam J. Cermak

(57) ABSTRACT

A bollard system includes leveling legs for each section of the system, support plates rotated to distribute force to supporting beams, and connecting angles to join together adjacent sub-assemblies within a single installation.

3 Claims, 7 Drawing Sheets

SHALLOW BOLLARD

This application claims priority under 35 U.S.C. § 119 to U.S. Provisional application No. 60/822,240, filed 13 Aug. 2006, the entirety of which is incorporated by reference herein.

BACKGROUND OF THE INVENTION

1. Field of the Invention

The present invention relates to devices, systems, and processes useful as bollards, and more specifically to ground level security bollards.

2. Brief Description of the Related Art

Bollards have been used to provide perimeter security for a secured facility. The bollards may restrict traffic flow and vehicle penetration into the facility grounds.

FIGS. 1*a* and 1*b* illustrate a typical security bollard installation system 100. Typically, current vertical bollards 110 are installed three (3) to four (4) feet deep in the ground 120. A trench is dug approximately three (3) feet wide and of a length determined based on the perimeter to be protected. The trench is filled with concrete 130 after the vertical bollards 110 are set in the trench. Installing the bollards 110 this deep caused problems with hitting underground utilities (gas, water, telephone, electricity), and underground parking and building structures.

Therefore, there remains a need for a bollard system that does not require a deep trench, yet is impact resistant and field adjustable.

SUMMARY

One of numerous aspects of the present invention includes a shallow bollard sub-assembly for securing an area against vehicular penetration comprising a base, an input member secured to the base and extending vertically from the base, wherein the input member is configured and arranged to transfer an impact to the base when a vehicle strikes the input member and at least three leveling legs connected to the base to position the base above a supporting surface, wherein each of the leveling legs is individually adjustable to alter an elevation of a respective portion of the base relative to the supporting surface.

Another aspect of the present invention includes a shallow bollard system for securing an area against vehicular penetration comprising a plurality of bollard sub-assemblies and a plurality of linking members connecting adjacent ones of the plurality of bollard sub-assemblies, wherein each of the bollard sub-assemblies each includes a base an input member secured to the base and extending vertically from the base, wherein the input member is configured and arranged to transfer an impact to the base when a vehicle strikes the input member, and at least three leveling legs connected to the base to position the base above a supporting surface, wherein each of the leveling legs is individually adjustable to alter an elevation of a respective portion of the base relative to the supporting surface.

Yet another aspect of the present invention includes a method for securing an area against vehicular penetration comprising providing a plurality of bollard sub-assemblies, each of the bollard sub-assemblies includes a base, an impact member secured to the base and extending vertically from the base, wherein the input member is configured and arranged to transfer an impact to the base when a vehicle strikes the input member, and at least three leveling legs, interconnecting one of the plurality of bollard sub-assemblies to an adjacent one of the bollard sub-assemblies, and adjusting a vertical position of at least a part of at least one of the bollard sub-assemblies relative to a supporting surface by moving appropriate ones of the at least three leveling legs.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1A:
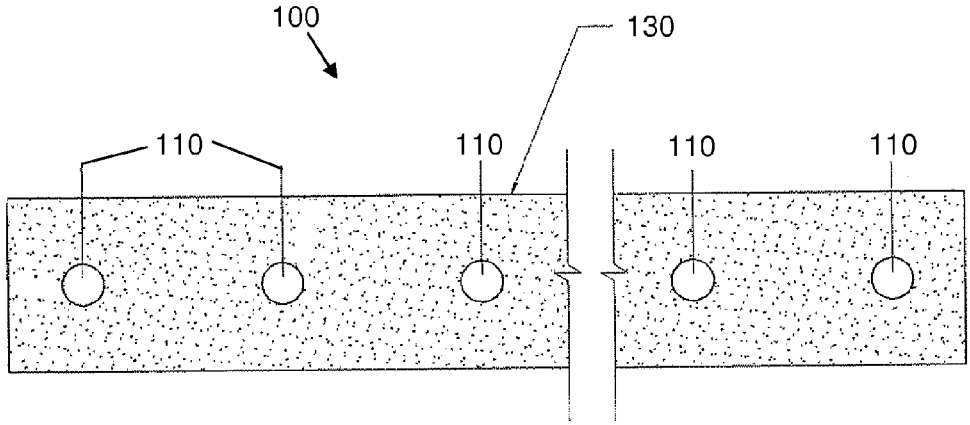
FIGS. 1*a* and 1*b* illustrate a typical, prior art bollard system.
Figure 1B:
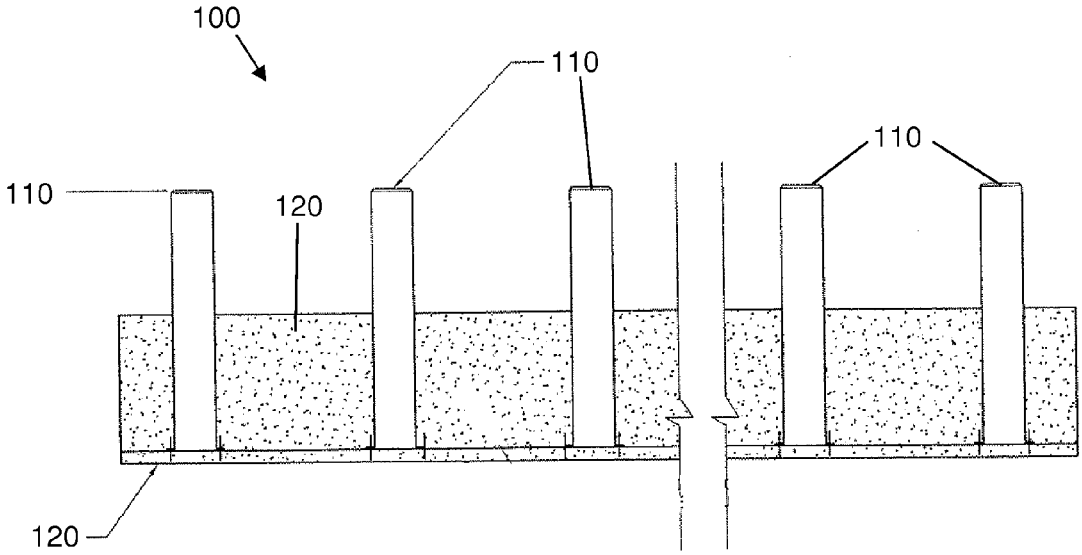

Referring to the drawing figures, like reference numerals designate identical or corresponding elements throughout the several figures.

Figure 2:
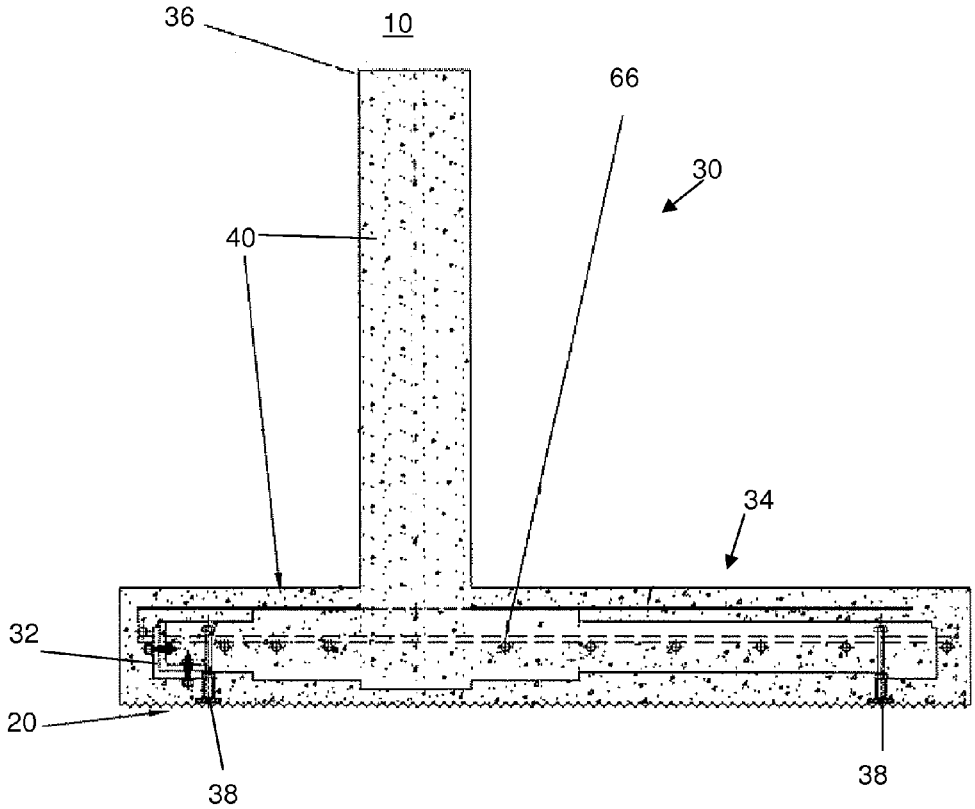
FIG. 2 illustrates a side elevational view of an exemplary bollard system embodying principles of the present invention, when installed.
Figure 5:
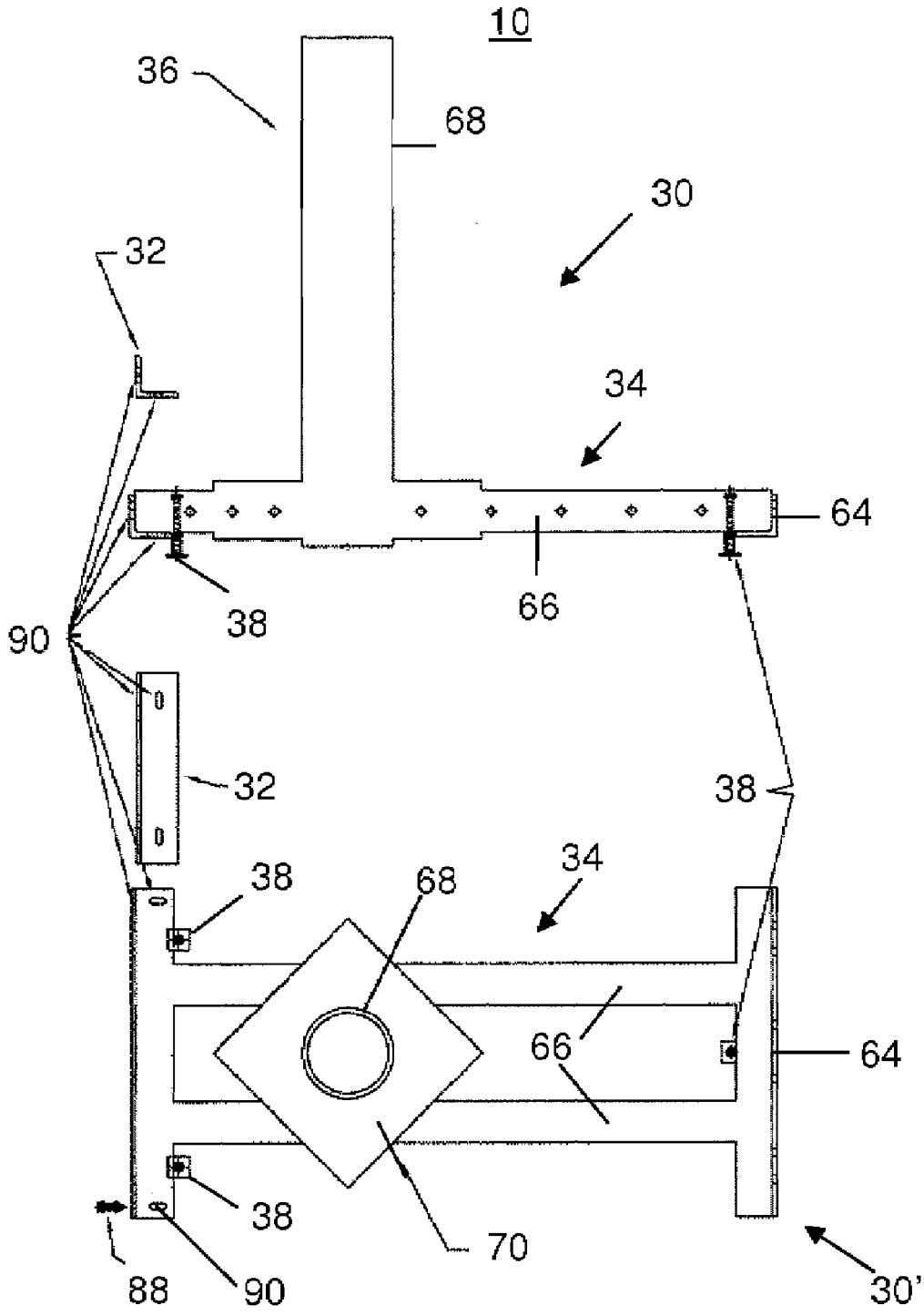
FIG. 5 illustrates views of a bollard system in accordance with the present invention, disassembled.
Figure 6:
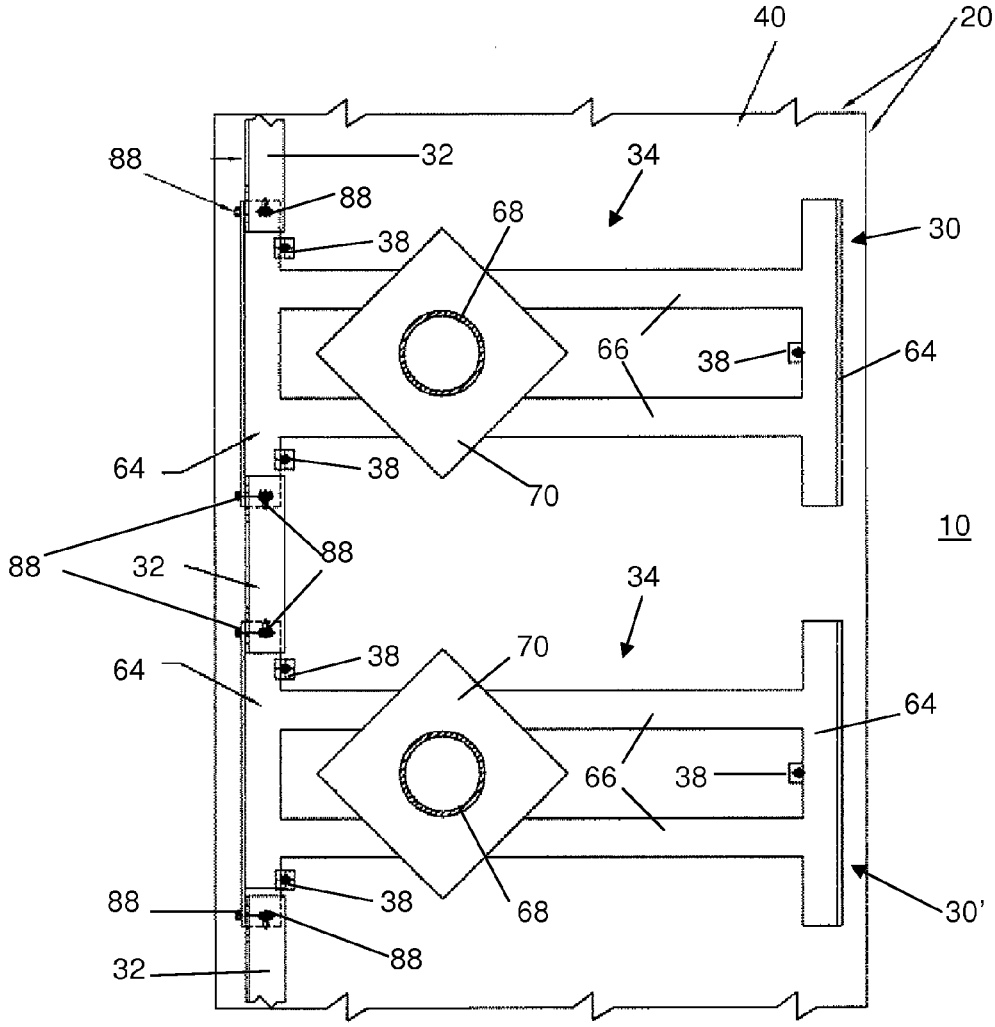
FIG. 6 illustrates views of a bollard system in accordance with the present invention, in an assembled configuration.

With reference to FIGS. 2, 5, and 6, an exemplary bollard system of the present invention includes a shallow mounted installation system 10. The shallow bollard system 10 typically may require a support surface 20 formed as only a nine (9) inch deep trench in the ground, or a recess or a channel formed in a building surface or a bed for a road or a sidewalk. Referring to FIGS. 5 and 6, the shallow bollard system 10 may include a plurality of shallow bollard sub-assemblies 30, 30' interconnected to one another by linking members 32 in a manner to be described later.

Figure 3A:
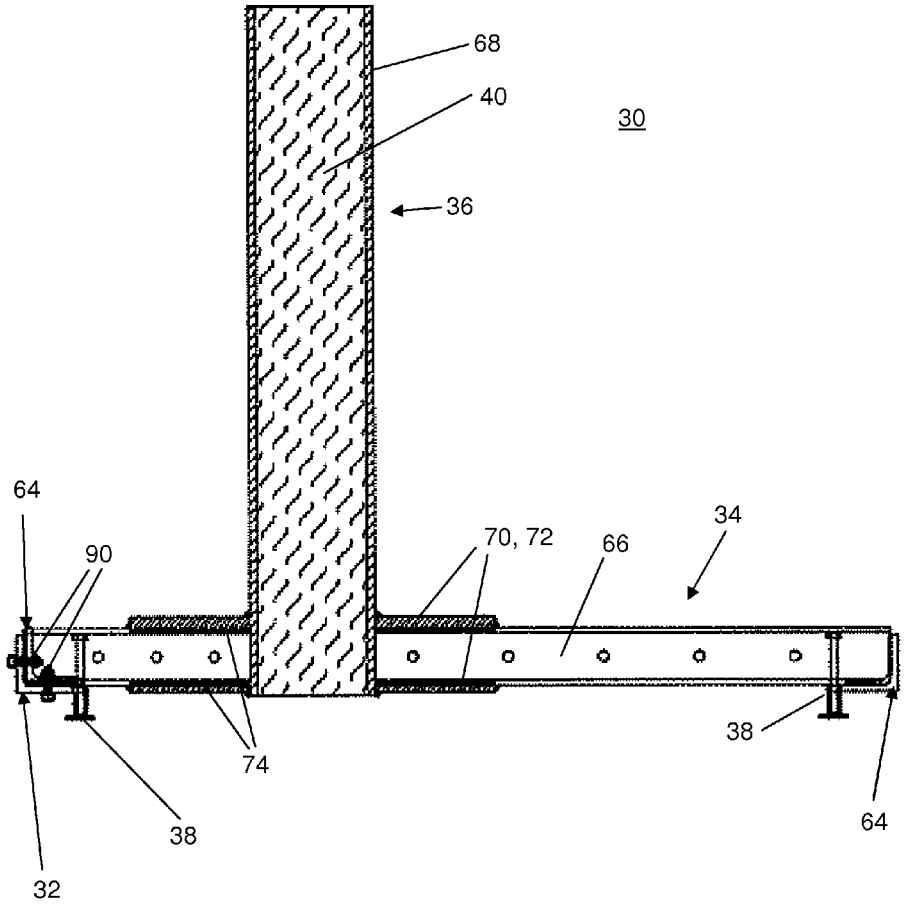
FIGS. 3*a* and 3*b* illustrate side elevational and top plan view, respectively, of a bollard system in accordance with the present invention.
Figure 3B:
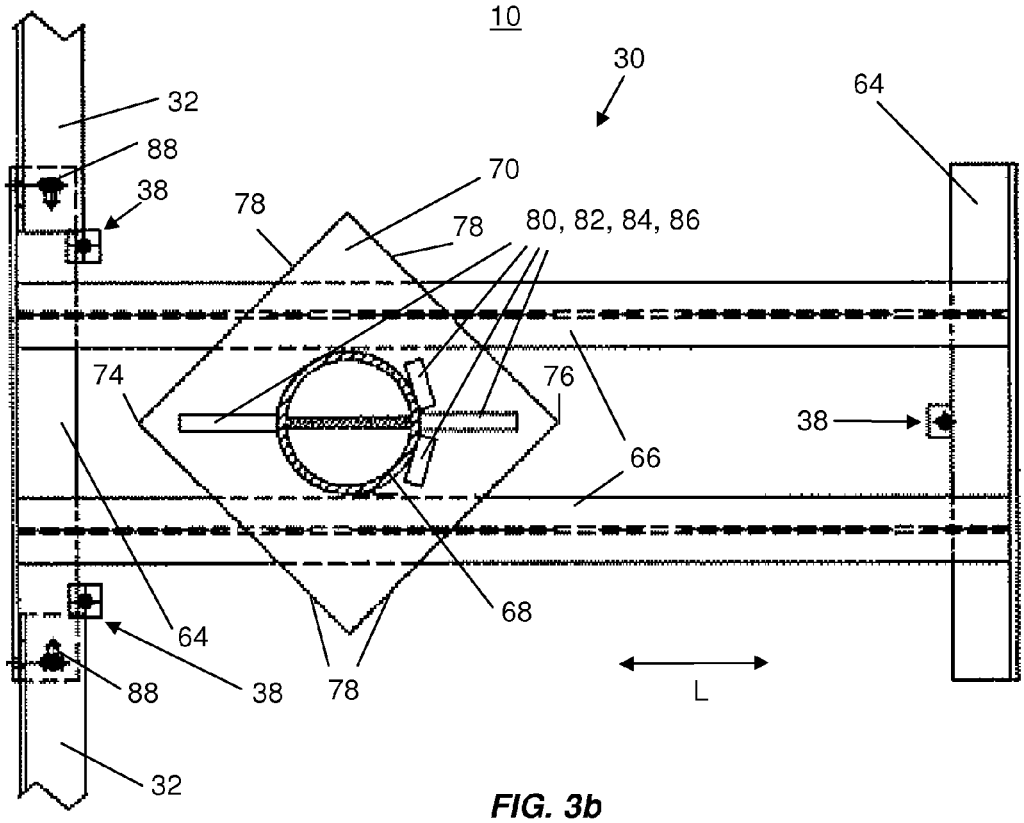

Referring to FIGS. 2, 3*a*, and 3*b*, each shallow bollard sub-assembly 30 may include a base 34, a vertical input member (or vertical bollard) 36, and a plurality of leveling legs 38. The shallow bollard sub-assembly 30 may be designed to transfer an impact from the input member 36 to the base 34 when a vehicle strikes the input member 36. The base 34, the leveling legs 38, and at least a portion of the impact member 36 may be encased in concrete 40 after the shallow bollard system 10 has been properly assembled, positioned and leveled, as illustrated in FIG. 2.

The surface 20 upon which the shallow bollard system 10 may be supported may take the form of a trench or other excavation, a contoured ground surface such as a bed for a road or sidewalk, or a surface of a building structure, and may be sloped, uneven and/or follow a curved path. The leveling legs 38 may be individually adjusted to level and align each shallow bollard sub-assembly 30 and may be adjusted as a group to raise and lower the respective bases 34 of the entire shallow bollard system 10 to the required elevation relative to the support surface 20 in order to accommodate varying contour(s) and path(s) of the support surface 20. The structure and adjustment of each level leg 38 is described next.

The shallow bollard sub-assembly 30 may have at least three leveling legs 38 disposed on the base 34 to define a triangular pattern (see, e.g., FIG. 3*b*). This pattern may provide the appropriate degree(s) of freedom of adjustment to obtain a level bollard system 10 with a minimum number of leveling legs 38. However, more leveling legs 38 and/or other arrangements of the leveling legs 38 relative to the base 34 may be provided.

Figure 4:
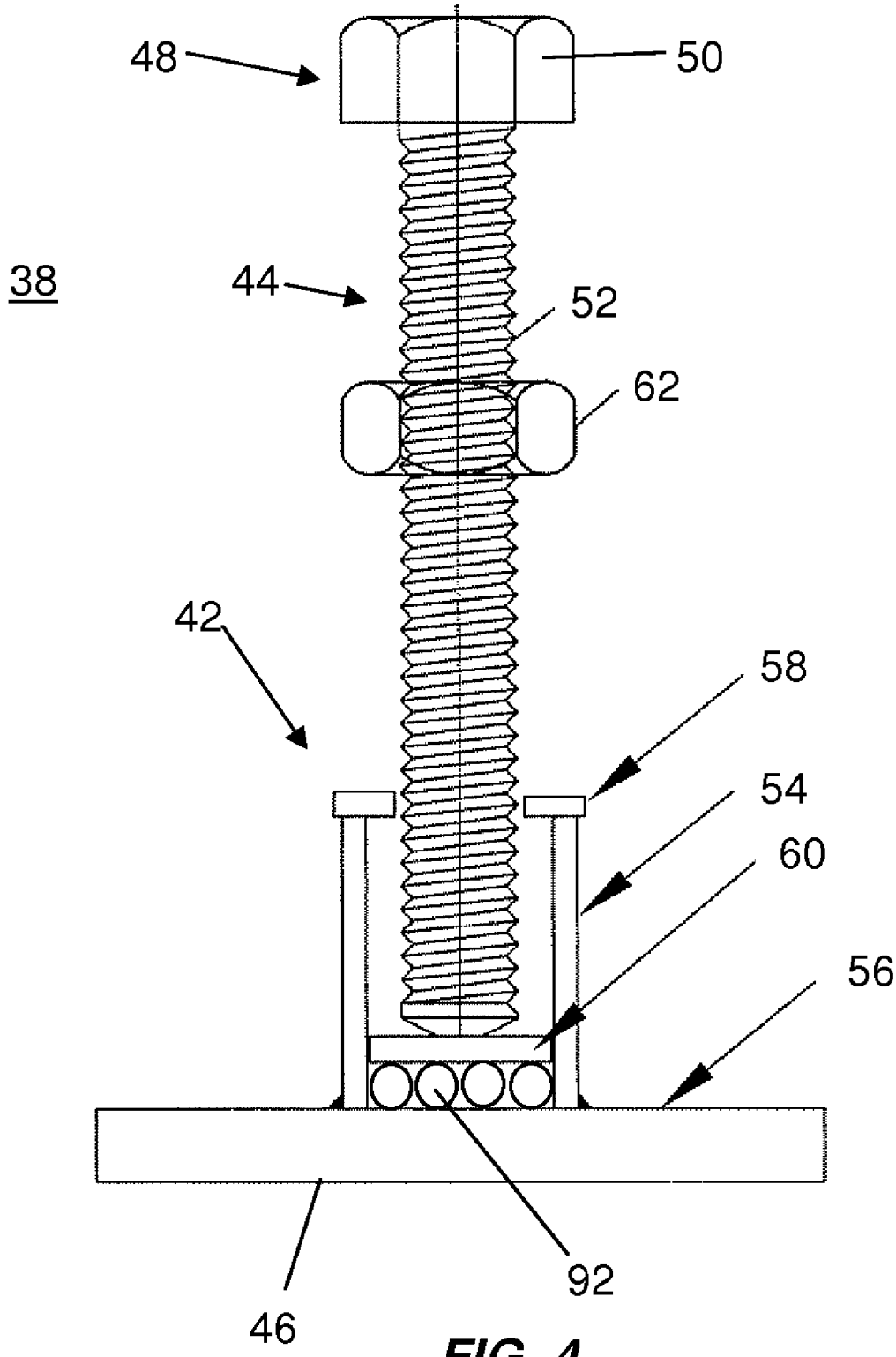
FIG. 4 illustrates an exemplary embodiment of a leveling leg in accordance with the present invention.

As viewed in FIG. 4, each leveling leg 38 may include a foot member 42 and an adjusting member 44. The foot member 42 may include a bottom surface 46 that may engage the support surface 20 (not shown, see FIG. 2) when the shallow bollard sub-assembly 30 (not shown, see FIG. 2) is positioned over the support surface 20. In a preferred embodiment, the adjusting member 44 may be a bolt 48 having a head 50 at one end of a threaded stud 52. Preferably, the foot member 42 may be loosely secured to the adjusting member 44 as explained below.

Still referring to FIG. 4, the foot member 42 may include a pipe 54 opened at each end. A pad 56 may be secured to and close off one of the opened ends. A washer 58 may be secured to the other opened end of the pipe 54. Preferably, the outer dimension of the washer 58 may be greater than the inner dimension of the pipe 54 and the inner dimension of the washer 58 may be less than the inner dimension of the pipe 54 and greater than the outer diameter of the threaded stud 52.

As illustrated in FIG. 4, a second washer 60 may be fixed to the end of the threaded stud 52 opposite the head 50. The outer dimension of the second washer 60 may be less than the inner dimension of the pipe 54 and greater than the inner dimension of the washer 58. Thus, the second washer 60 may be captured between the washer 58 and the pad 56, thereby loosely securing the foot member 42 to the adjusting member 44. Alternatively, the foot member 44 may be rigidly fixed to the bolt 48. Optionally, yet not necessary, provisions can be added to reduce the friction between the pad 56 and the washer 60, to permit easier rotation of the stud 52. By way of non-limiting example, a number of ball bearings 92 can be located in the space between the pad 56 and the washer 60, which are free to roll. Other provisions, such as liquid, paste, or solid lubricants, or the like, can also be used to reduce the rotating friction between the pad 56 and the washer 60.

Prior to securing the foot member 42 to the bolt 48, a nut 62 may be threaded onto the threaded stud 52. See FIG. 4. Preferably, the nut 62 may be rigidly fixed to the base 34 (not shown, see FIGS. 3*a* and 3*b*) by a weld between the nut 62 and a respective connecting member 64 of the base 34. See FIGS. 3*a* and 3*b*. In order to adjust the elevation of the base 34, the bolt 48 may be rotated clockwise or counter-clockwise relative to the nut 62, thereby raising or lowering the foot member 42 relative to the base 34. Alternatively, the base 34 may be provided with a through bore that may directly engage the threaded stud 52.

Other arrangements of the adjusting member and the foot portion may be possible, in so far as the adjusting member is non-movably secured to one of the foot member and the base and movably engaged with the other of the foot member and the base. For example, a threaded stud may be rigidly fixed to the base and extend from the base and the foot member may have a threaded portion, such as a nut welded thereto, such that rotation of the foot member relative to the stud raises or lowers the position of the foot member relative to the base. Alternatively, the adjusting member may be a fluid powered piston/cylinder arrangement, a gear assembly such as rack and pinion arrangement, a ratchet-type assembly, etc.

Referring to FIGS. 3*a* and 3*b*, the base 34 may include two horizontal members 66 and two connecting members 64. The horizontal members 66 extend in a longitudinal direction L (see FIG. 3*b*) and the connecting members 64 may extend perpendicular to the longitudinal direction L (see FIG. 3*b*), or optionally can form angles with the horizontal members other than 90 degrees. The horizontal members 66 may be connected to one another by the connecting members 64. The connecting members 64 may be secured to the ends of the horizontal members 66 by any conventional means, such as bolts, rivets, or welds. Preferably, the connecting members 64 may be welded to the horizontal members 66. The connecting members 64 may be provided to spread the impact load from the input member 36 to the concrete 40 subsequent to a vehicle striking the input member 36. See also FIG. 2.

In the preferred embodiment of FIGS. 3*a* and 3*b*, the horizontal members 66 may be I-beams and the connecting members 64 may be angle irons. Alternatively, the base 34 may be formed of a single metal sheet, cast as frame, machined from a single piece of metal, etc.

Referring to FIG. 3*a*, preferably, the input member 36 may include a hollow pipe 68 that may receive concrete 40 therein after the bollard sub-assembly 30 has been properly positioned and leveled on the support surface 20 (see also FIG. 2). In order to secure the input member 36 to the base 34, the hollow pipe 68 may be inserted into holes in upper and lower square plates 70, 72. The square plates 70, 72 may be welded (at 74) to the top and bottom of the horizontal members 66.

Preferably as shown in FIG. 3*b*, the square plates 70, 72 are oriented relative to the horizontal members 66 such that a line extending between a pair of diagonally opposed corners 74, 76 of each square plate 70, 72 extends parallel to the longitudinal direction L of the horizontal members 66. This preferred orientation locates the edges 78 of the square plates 70, 72 at a preferred angle of 45° relative to the longitudinal direction L of the horizontal members 66. Of course, other angular orientations of the plates 70, 72 to each other and to the horizontal members 66 can also be used.

After the shallow bollard system 10 is properly leveled and encased in concrete 40, this preferred orientation may allow maximum contact of the square plates 70, 72 to the concrete 40 at impact caused by a vehicle striking the input member 36. At the time of impact on the input member 36 by a vehicle, with the system preferably, although not necessarily, oriented so that the vehicle impacts the system from the left in the drawing figures, the energy from the concrete-filled hollow pipe 68 may be transferred through the square plates 70, 72 to the horizontal members 66 and into the concrete 40. The concrete 40 may be relied upon to provide mass since, at impact by a vehicle, the bollard sub-assemblies 30 may try to rotate and/or translate relative to the support surface 20.

FIG. 3*b*, by way of example, also illustrates stiffener plates 80, 82, 84, 86 that may extend vertically between and connect to the upper and lower square plates 70, 72. During impact by a vehicle, the input member 36 may rotate back. The stiffener plates 80, 82, 84, 86 may help transfer energy from the upper square plate 70 to the lower square plate 72 (see also FIG. 3*a*) and the horizontal members 66 and the concrete 40 such that this backward rotation may be prevented or at least minimized. The stiffener plates 80, 82, 84, 86 are not illustrated in the other drawing figures so as to not otherwise obscure aspects of the invention.

The bollard sub-assembly 30 may be connected to an adjacent bollard sub-assembly 30' by linking members 32. See FIGS. 5 and 6. The linking members 32 may be connected to the bollard sub-assemblies 30 by bolts 88, or by other devices such as rivets, welds, and the like. As shown in FIG. 5, a single linking member 32 may be used to connect the two shallow bollard sub-assemblies 30, 30'. However, any number of linking members 32 may be used to connect the adjacent bollard sub-assemblies 30.

As illustrated by way of example in FIG. 5, bolt holes 90 in each linking member 32 may be slotted in a direction perpendicular to the longitudinal direction L (see FIG. 3*b*) of the horizontal members 66 and each base 34 may include bolt holes 90 that may be slotted in the longitudinal direction L of the horizontal members 66. This orientation of the bolt holes 90 may provide for adjustment for a curved path intended for the bollard system 10 and/or an uneven or sloping support surface 20.

The linking members 32 may also be useful to provide proper spacing between two adjacent bollard sub-assemblies 30. The bollard sub-assemblies 30 may be, according to an advantageous embodiment, spaced a minimum of 32" (for handicapped access) and maximum of 34", for impact and structural requirements, although other spacings between adjacent bollard sub-assemblies 30 are also part of this invention.

Preferably, the linking member 32 may be formed from angle iron for structural strength. See FIG. 5. While the linking member 32 may be formed of a different material and/or shape, preferably it is formed of the same material (e.g., steel) as the angle iron of the connecting members 64 of the base 34.

The linking member 32 may help keep the bollard system 10 from moving by transferring the impact load from a vehicle on the input member 36 to an adjacent bollard sub-assembly 30 and throughout the concrete 40.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents.

What I claim is:

1. A shallow bollard sub-assembly for securing an area against vehicular penetration comprising:

a base;

an input member secured to the base and extending vertically from the base, wherein the input member is configured and arranged to transfer an impact to the base when a vehicle strikes the input member; and at least three leveling legs connected to the base to position the base above a supporting surface, wherein each of the leveling legs is individually adjustable to alter an elevation of a respective portion of the base relative to the supporting surface;

wherein each of the leveling legs comprises:

a foot member adapted to engage the supporting surface; and an adjusting member secured to one of the foot member and the base and movably engaged with the other of the foot member and the base such that an elevation of the respective portion of the base relative to the supporting surface changes upon movement of one of the adjusting member and the foot member relative to the base;

wherein the adjusting member includes a bolt having a head at one end thereof and a threaded stud extending from the head;

wherein the base includes a nut engaging the threaded stud and fixed to the base; and wherein the foot member includes:

a hollow pipe having first and second open ends;

a pad connected to and closing one of the first and second open ends of the hollow pipe; and a first washer secured to the other one of the first and second ends of the hollow pipe, wherein the threaded stud passes through the first washer and extends into the hollow pipe; and wherein the adjusting member further comprises a second washer connected to an end of the threaded stud opposite the head and captured in the hollow pipe between the pad and the first washer.

2. The shallow bollard sub-assembly according to claim 1, wherein the hollow pipe has an inner dimension, the threaded stud has an outer diameter, the first washer has a first outer dimension and a first inner dimension, and the second washer has a second outer dimension, wherein the first outer dimension is larger than the inner dimension, the second outer dimension is less than the inner dimension and greater than the first inner dimension, and the outer diameter is less than the first inner dimension.

3. A shallow bollard sub-assembly for securing an area against vehicular penetration comprising:

a base;

an input member secured to the base and extending vertically from the base, wherein the input member is configured and arranged to transfer an impact to the base when a vehicle strikes the input member; and at least three leveling legs connected to the base to position the base above a supporting surface, wherein each of the leveling legs is individually adjustable to alter an elevation of a respective portion of the base relative to the supporting surface;

wherein the base includes:

two horizontal members; and two connecting members secured to the horizontal members;

wherein two of the leveling legs are connected to a common one of the connecting members and a third one of the leveling legs is connected to another one of the connecting members such that the leveling legs define a triangular pattern;

a first square plate connected to the second hollow pipe and to each of the horizontal members such that a first pair of diagonally opposed corners of the square plate extends parallel to the horizontal members;

a second square plate connected to the second hollow pipe and to each of the horizontal members such that a second pair of diagonally opposed corners of the second square plate extend parallel to the horizontal members; and a plurality of stiffener plates secured to the second hollow pipe and each of the first and second square plates.

* * * * *